United States Patent [19]

Buxbaum

[11] Patent Number: 4,932,456

[45] Date of Patent: Jun. 12, 1990

[54] BEAD-CHAIN DRIVE FOR ROLL UP BLINDS

[76] Inventor: Gary Buxbaum, 15 Clent Rd. - Apt. 3E, Great Neck, N.Y. 11021

[21] Appl. No.: 374,757

[22] Filed: Jul. 3, 1989

[51] Int. Cl.[5] ..... A47H 1/00

[52] U.S. Cl. ..... 160/321; 160/300; 160/308

[58] Field of Search ..... 160/321, 291, 297, 300, 160/301, 304.1, 307, 308, 319

[56] References Cited

U.S. PATENT DOCUMENTS

| | | | |
|---|---|---|---|
| 197,234 | 11/1877 | Wagner | 160/308 X |
| 2,564,831 | 8/1951 | Butkus | 160/321 X |
| 2,773,547 | 12/1956 | Voss | 160/301 |
| 2,894,578 | 7/1959 | Caesar et al. | 160/308 |
| 3,854,517 | 12/1974 | Nakamura | 160/321 X |
| 4,139,044 | 2/1979 | Brolin | 160/321 |
| 4,475,580 | 10/1984 | Hennequin | 160/308 |
| 4,476,910 | 10/1984 | Saito | 160/291 |
| 4,779,662 | 10/1988 | Wilk | 160/321 |

FOREIGN PATENT DOCUMENTS

| | | | |
|---|---|---|---|
| 3522121 | 10/1986 | Fed. Rep. of Germany | 160/297 |

*Primary Examiner*—David M. Purol

[57] ABSTRACT

The disclosed ball-chain drive for a wind-up blind has a chain-activated locking device that acts directly on the sprocket and remains effective even if the ball chain breaks or is jostled. The locking device in one form has such symmetry that the ball-chain drive is usable at either end of the wind-up blind.

18 Claims, 2 Drawing Sheets

BEAD-CHAIN DRIVE FOR ROLL UP BLINDS

The present invention relates to a bead-chain drive for roll-up blinds, as for a window.

A bead-chain drive for a roll-up blind includes a sprocket that is fixed to a rotatable core on which the blind is wound, and a bead chain that meshes with the sprocket. Pulling the chain causes the sprocket to turn and wind the blind on the core. A weighted lower margin of the blind, or the weight of the blind itself, tends to unroll the blind. The sprocket turns correspondingly, transporting the bead chain. The blind is arrested in a desired adjustment by shifting the portion of the chain into interlocking fit with a detent. Later, when the adjustment is to be changed, the bead chain is pulled out of engagement with the detent, so that the chain and the sprocket and the roll-up blind are freed for operation.

When the blind is left in any adjustment, its weight tends to turn its winding core, driving the sprocket. In turn, the sprocket tensions that portion of the chain which extends between the detent and the sprocket. If the chain were to become dislodged from the detent or if any tensioned portion of the chain should break, the window blind would come crashing down.

In one aspect of the present invention, retention of the window blind in any adjustment does not depend on the chain. It may break or it may be jostled, without releasing the window blind. In the illustrative embodiments of the invention described in detail below and shown in the drawings, a dog is provided having two selective positions. In one position, the dog locks the sprocket against being turned in the unwinding direction. In its other position, the dog does not obstruct the sprocket. The chain is manipulated t adjust the blind and then the chain is interengaged with the dog and, with a slight release stroke of the chain, the chain shifts the dog into stable interengagement with the sprocket. Thereafter, further relaxation of the pull on the chain has the effect of allowing the sprocket to turn in the blind-unwinding direction; and in this movement, the sprocket carries the dog with it and shifts the locking device against a barrier. The sprocket is thus locked against further movement in the unwinding direction. Retention of the blind in its adjustment does not depend on the chain, whether it should break or whether it should be jostled out of engagement with the dog-activating portion of the locking device.

It may be considered that the blind hangs down from the "rear" of the roller to which the sprocket is fixed, and the sprocket is operated to wind the blind by pulling the length of ball chain at the "front" of the roller. In one illustrative embodiment of the invention detailed below, the ball-chain drive comprising the ball chain, the sprocket and the locking device can only be mounted at one end of the roller for the locking device to work by manipulating the "front" length of chain with the weighted blind hanging down from the "rear" of the roller. In a second embodiment, the ball-chain drive can be mounted at either end of the roller, and the locking device functions as intended regardless of whether the drive (with its locking device) is mounted at the right-hand end of the roller or at its left-hand end.

The nature of the invention and its various novel aspects and advantages will be better appreciated from the following detailed exposition of the illustrative embodiment of the invention shown in the accompanying drawings.

In the drawings

Figure 2:
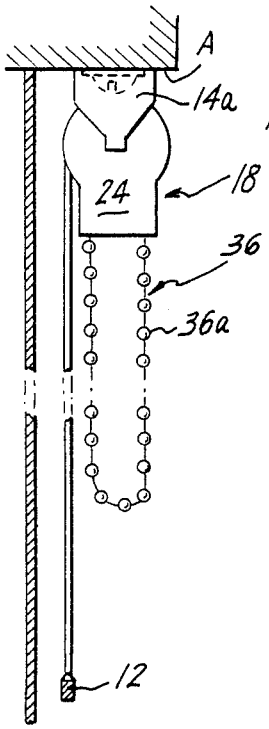
FIG. 2 is a left-side elevation of the blind and its drive means of FIG. 1.

Referring now to the drawings, a roll-up window blind 10 is shown, a portion 10*a* of which is wound about an internal core; and the blind is weighted, either by metal bar 12 or by the weight of the blind itself, so as to have a prominent tendency to unwind. The blind may be made of any of a range of materials, such as those commonly used for window shades, parallel reeds tied together, slats, etc.

At the left and at the right, there are sheet-metal brackets 14 and 16 that fit the corners of the opening A that contains the blind. As shown, screws or other fasteners secure the brackets flush against frame A.

Figure 4:
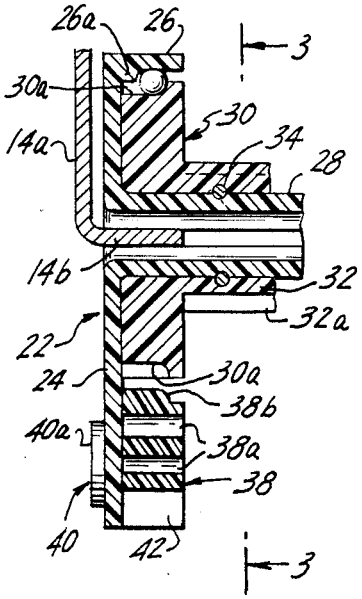
FIG. 4 is a cross-section of the ball-chain drive of FIG. 3 as viewed from the broken-line section 4—4 in FIG. 3.
Figure 3:
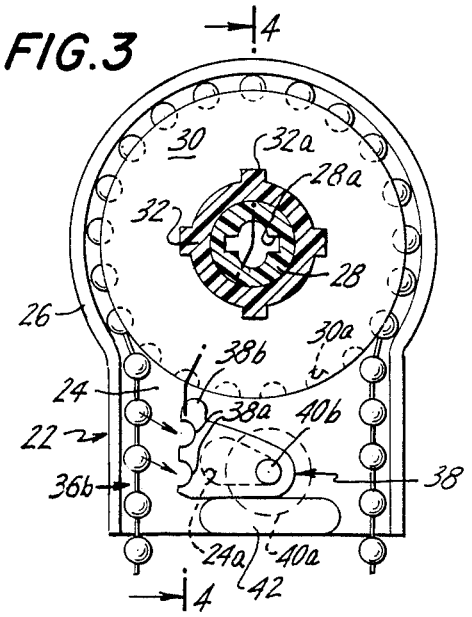
FIG. 3 is a slightly enlarged view, partly in cross-section, of a ball-chain drive for the window blind of FIGS. 1 and 2, as viewed from the plane 3—3 of FIG. 4.
Figure 5:
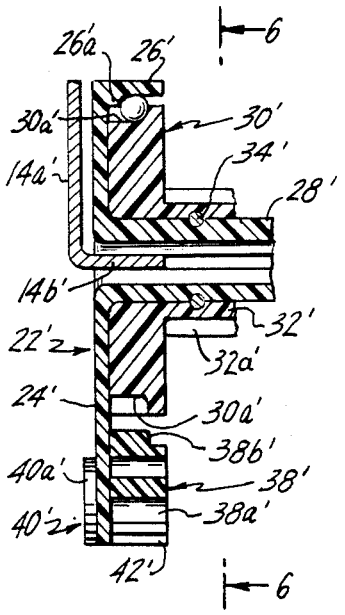
FIG. 5 is a view like FIG. 4 of an alternative ball-chain drive, shown in cross-section as viewed from the broken-line section 5—5 in FIG. 6.
Figure 6:
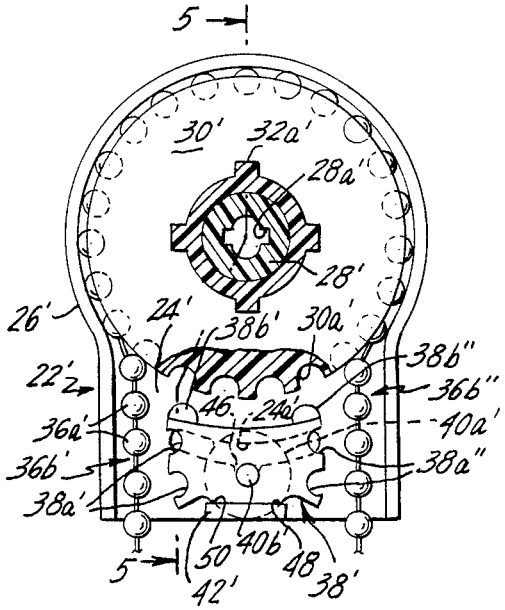
FIG. 6 is a view of the ball-chain drive of FIG. 5, partly in cross-section, largely as seen from the plane 6—6 in FIG. 5.

Brackets 14 and 16 have flat vertical areas or panels 14*a* and 16*a* extending opposite to structures 18 and 20 that rotatably support the core of the roll-up blind. The left-hand structure 18, described in detail below, has the capability of operating relatively heavy blinds. Two alternative forms of mechanism 18 are shown in FIGS. 3 and 4 and in FIGS. 5 and 6. The mechanism of FIGS. 3 and 4 is suitable for use at only one end of the roller when the blind depends from the rear of the roller and the mechanism is operated by manipulating the depending length of ball chain at the "front" of the blind wound on its core. The alternative of FIGS. 5 and 6 is symmetrical, in that it is operable in the just-described manner regardless of whether it is mounted at one end or the other of the core. In FIGS. 3 and 4, a stationary support member 22 includes a vertical panel 24. Rim 26 extends approximately three quarters of a circle around the axis of stub shaft 28; and straight vertical portions of rim 26 extend from the front and back margins (see FIG. 2) of the lowermost area of panel 24.

Panel 14*a* includes a horizontal tang 14*b* (FIG. 4) that extends into complementary passage 28*a* in stub shaft 28. Tang 14*b* in passage 28*a* (FIG. 3) acts to fix support member 22 in the position or attitude represented in FIG. 3.

The mechanism includes a sprocket 30 having a bushing 32 that extends along stub shaft 28 and is rotatably supported on the stub shaft Parallel splines 32*a* extend along and project outward from bushing 32. Splines 32*a* are to mate with grooves in a tube (not shown) which forms the core of the roller. Bushing 32 and its splines have a tight fit in the core, so that the sprocket can only be removed from the core with great effort after it has been forced into the core. The sprocket and the core are unitary parts of a roller for winding and unwinding the blind. A retainer such as a snap ring 34 (suitably proportioned and positioned) holds sprocket 30 and panel 24 in face-to-face contact.

A ball-chain 36 in the form of an endless loop depends from mechanism 18 Ball chain 36 extends roughly three-fourths of the way around sprocket 30. Regularly spaced pockets or cavities 30*a* are distributed around the sprocket's periphery, at positions matching the distribution of balls 36*a* of the ball chain in its extended condition. The shape of pockets 30*a* as shown is to facilitate making the sprocket 30 and its bushing 32 as one injection-molded part. Rim 26 has a step 26*a* that complements the sprocket in keeping the balls 36*a* centered between the opposite faces of sprocket 30. This form of sprocket for a ball chain, complemented by rim 26, 26*a*, is illustrative of various forms of ball-chain drives that may be used.

A locking device 38 is disposed below sprocket 30 in what may be called a "free range" of the sprocket, between the larger range of pockets of the sprocket that are occupied by balls of the sprocket. It is slidable along a surface of panel 24. A fastener 40 has a head 40*a* that slides along the opposite surface of panel 24, and fastener 40 has a post 40*b* that is fixed in locking device 38. Post 40*b* extends through hole 24*a* in panel 24 so that locking device 38 is constrained to slide along the right-side surface (FIG. 4) of panel 24. A portion 42 of support member 18 projects from panel 24. In the condition of FIG. 3, locking device 38 rests against support 42.

The left-hand edge (FIG. 3) of device 38 includes two cavities 38*a* like cavities 30*a* in sprocket 30, shaped and spaced apart for cooperating with ball chain 36. The portion of locking device 38 that cooperates with ball chain 36 may be called the "activating portion" of the locking device. A knob or projection 38*b* at the upper left-hand corner (FIG. 3) of the locking device is shaped complementary to sprocket cavities 30*a*. That portion of locking device 38 that locks the sprocket, apart from its activating portion but including its knob 38*b* may be called a "locking dog" or a "dog".

An at-rest condition of the locking mechanism is represented in FIGS. 3 and 4. Sprocket 30 and chain 36 are unrestrained, so the weighted blind is completely unrolled. To raise the blind, the forward length of ball chain 36 (at the right in FIG. 2 and portion 36*b* in FIG. 3) is pulled straight down, using as many strokes as may be needed to adjust the blind. Then, depending portion 36*b* of the ball chain is shifted to the right (in FIG. 3) and moved down slightly if necessary so that balls 36*a* are received in cavities 38*a*. Pin portion 40*b* bears against the right-hand edge of hole 24*a*, resisting the pressure of the ball chain against the activating portion of the locking device. When two balls of the chain are in cavities 38*a*(one ball would be sufficient), knob 38*b* is disposed opposite to a cavity 30*a* of the sprocket because the connected balls of the chain are effective to position a sprocket cavity 30*a* opposite knob 38*b*.

While chain portion 36*b* is held against the locking device 38, the chain is allowed to move upward, and the weighted blind causes sprocket 30 to turn clockwise (FIG. 3). Chain 36 causes locking device 38 to tilt, moving clockwise about pin 40*b* as a pivot, and knob 38*b* is shifted into a vacant cavity 30*a* of the sprocket. This shift of the locking device in which the knob is shifted by the chain from its at-rest position (free of engagement with the sprocket) into what may be called "non-slipping engagement" with the sprocket represents an initial mode of operation of the locking device. Sprocket 30 is turning clockwise at this time. Accordingly, the engagement of knob 38*b* in a cavity 30*a* shifts locking device 38 t the left in FIG. 3. This shift of the locking device with knob 38*b* in a pocket of the sprocket represents a further mode of operation of the locking member. Rotation of the sprocket induces this further motion of the locking device, the knob 38*b* being in non-slipping engagement with one of the pockets of the peripheral formation of the sprocket. The tear-shaped hole 24*a* (FIG. 3) which is formed in wall 24, provides the space that accommodates that movement of pin 40*b* which occurs during the "further mode" of operation of the locking device. Ultimately, that leftward shift of locking device 38 is blocked. Accordingly, arrested knob 38*b*, which is in a cavity 30*a* of the sprocket, blocks rotation of the sprocket. Because the sprocket is locked, unrolling of the blind is prevented even if the chain should break, and even if the chain were jostled out of cooperation with the activating portion of the locking device.

The locking device is readily released for making a new adjustment of the blind. Chain portion 36*b* is pulled downward to the right. (FIG. 3) shifting locking device 38 to the right. Then, without allowing the chain to move upward, the depending chain portion 36*b* is shifted to the left and the locking device is left in its released condition, represented in FIG. 3. Ball chain 36 is then manipulated to make any desired new adjustment of the blind.

Support member 22 (including portions 24, 26, 28 and 42) and sprocket 30 with its stub shaft 32 are one-piece components of molded plastic in the described mechanism; locking device 38 is of plastic component 40 is preferably of metal and brackets 14 are of sheet metal, in the exemplary illustrative apparatus shown in the drawings.

The embodiment f FIGS. 5 and 6 is the same in many respects as that of FIGS. 3 and 4. Primed reference numerals are used in FIGS. 5 and 6 to designate components that are the same as, or similar to, like-numbered parts in FIGS. 3 and 4. The description of identical parts and their cooperation as described in connection with FIGS. 3 and 4 applies also to FIGS. 5 and 6.

Locking device 38' is secured to panel 24' by fastener 40' so as to allow locking device to slide relative to hole 24*a'* in panel 24'. Locking device 38' has two activating portions, one activating portion being identified with ball-receiving cavities 38*a'* and the other activating portion identified with mirror-image cavities 38*a''*. Pin 40*b'* is unified with locking device 38'. Knob 38*b'* is related to recesses 38*a'* so that, when knob 38*b'* is in a cavity 30*a'* and balls 36*a'* are in cavities 30*a'*, other balls 36*a'* are aligned with, or received in, cavities 38*a'*. The same is true of recesses 38*a''*, and knob 38*b''* in relation to sprocket cavities 30*a'* and balls 36*a'* when knob 38*b''* is received in a cavity 30*a'*.

Hole 24*a'* has a slot portion 46 that restrains pin 40*b'* from moving toward the left (FIG. 6) when balls of chain portion 36*b''* are pressed into recesses 38*a''*. Slot 46 restrains pin 40*b'* from moving to the right (FIG. 6) when balls 36*a'* of chain portion 36*b'* are pressed into recesses 38*a'*. Hole 24*a'* also comprises an arcuate hole that curves about the sprocket. Segments of that arcuate slot extend to the right and left from slot portion 46. When pin 40*b'* is raised out of slot portion 46, the pin can move to the left or right along those arcuate slot segments in the operation of the mechanism as further described below. The edges of the arcuate slot which are farthest from the axis of the sprocket prevent pin 40*b'* from shifting away from the sprocket's axis when the pin is received in either of the slot segments. Consequently, at least one of the knobs 38b' is interlocked with the sprocket as it carries the pin and the whole locking member to the left (or to the right) from slot portion 46. When pin 40b' is returned to slot portion 46, the pin is free to drop. Slot portion 46 forms a relief that allows knob 38a' to drop out of interlocked engagement with the sprocket.

Consider the mechanism of FIG. 6 being used with a blind that hangs down from a core at the right of sprocket 30'. Chain portion 36b' may be pulled downward in successive strokes to wind the blind around the core. When the proper adjustment of the blind is reached, chain portion 36b' is shifted to the right (FIG. 6) and slightly downward if necessary for balls 36a' to be received in recesses 38a'. Relaxing the pull on chain portion 36b' allows the weight of the blind to turn sprocket 30' clockwise. Locking device 38' is then forced to tilt clockwise about its pivot portion 48 bearing against support 42'; and as knob 38b' is raised, pin 40b' is raised in slot 46 and knob 38b' enters a sprocket cavity 30a'. The motion of the locking member from its at-rest condition until knob 38b' enters a cavity 30a' represents the initial phase or mode in the operation of the locking member. As the sprocket continues to turn clockwise (chain portion 36b' being allowed to shift upward) sprocket 30' drives knob 38b' to the left (FIG. 6) , pin 40b', having been drawn out of slot 46. Pin 40b' moves along the arcuate slot portion of hole 28a' in a further mode of operation of the locking member, after the initial mode. Ultimately, locking device 38' is blocked against moving toward the vertical portion of rim 26'. At this point locking device 38' is arrested; and knob 38b' arrests sprocket 30' against any further rotation. The blind is locked.

Pulling chain segment 36b' down and to the right (FIG. 6) restores locking device 38' to the position in FIG. 6; and then chain 36' can be manipulated to readjust the blind.

Figure 1:
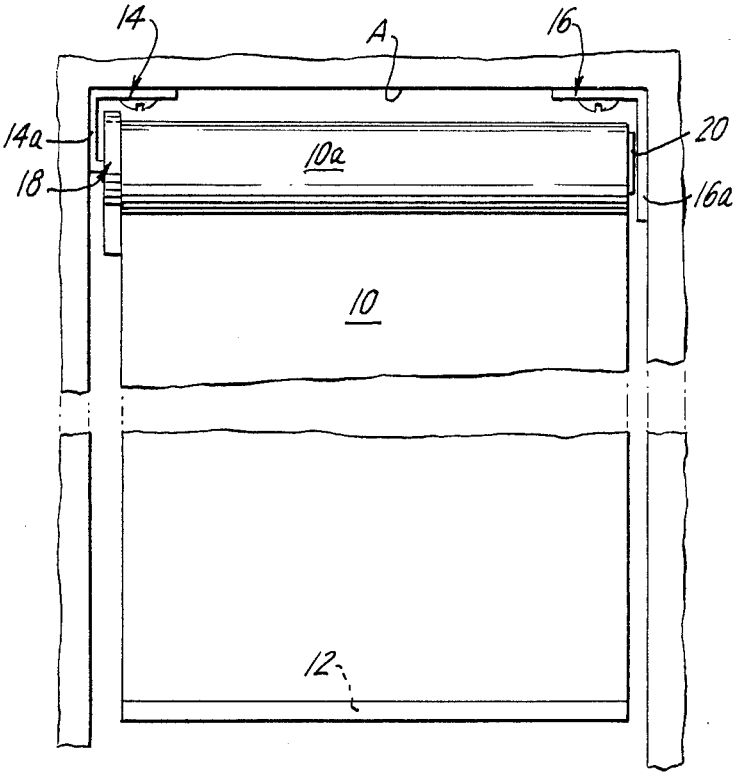
FIG. 1 is a reduced-scale front elevation of a window blind and its drive means, in place in a window frame.

Notably, if the mechanism of FIGS. 5 and 6 were mounted at the right-hand end of the wound blind 10a in FIG. 1, with the blind hanging down from the left side (FIG. 6) of sprocket 30', the same character of operation would occur, wherein: chain portion 36b'' cooperates with cavities 36a'' of the right-side activating portion of locking device 38'; locking device 38' is rocked counterclockwise about pivot portion 50 (which bears against support portion 42') as the weight of the blind turns sprocket 30' counterclockwise; pin 40b' rises in slot 46; knob 38b'' is caught in a cavity 30a' and pulled to the right (sprocket 30' turning counterclockwise) and pin 40b' is pulled all the way out of slot 46 and into the arcuate slot portion of hole 28a'; and finally knob 38'' is locked, locking device 38' being blocked against movement toward vertical portion of rim 26'. This is the locking condition of the mechanism; sprocket 30' cannot turn both because chain 36' is locked and its balls are in pockets 30a' and, because knob 38b'' is in a pocket 30a', the sprocket is prevented from turning even if the chain were to be broken.

In FIG. 6, parts 38a'' and 38b'' are mirror-images (about a vertical center-line through pin 40b') of parts 38a' and 38b', a symmetry that promotes like performance in the two circumstances in which the ball-chain drive may be used.

In FIG. 3, the weight of member 38 is supported by portion 42, but if desired a spring may be added for assurance that member 38 will assume the position shown when the locking device is at rest, not in its sprocket-locking condition. Correspondingly, member 38' has the natural tendency of settling down against support 42' with its pin 40b' in slot 46; but if desired, a spring can be added to supplement the weight of member 38' for assuring its position as illustrated, when that locking device is not in its sprocket-locking condition.

The embodiments of FIGS. 1–4 and FIGS. 5 and 6 have many common traits, some of which are noted above. As in many mechanisms for operating the core on which a blind is wound, operation of the chain in the two embodiments is not encumbered in any way by the locking device in raising and lowering the blind. In both embodiments, the chain is deliberately manipulated into engagement with the locking device for activating the locking device, and the chain is moved in the same direction into engagement with the locking device for releasing the locking device.

The illustrative embodiment of the invention in its various aspects as described above and shown in the drawings may be modified and it may be applied variously by those skilled in the art, so that the appended claims should be construed broadly in accordance with the true spirit and scope of the invention.

What is claimed is:

1. A ball-chain drive for a roll-up blind that is weighted so that it tends to unroll, said drive including a support member, a sprocket carried by said support member and having regularly spaced peripheral pockets, a ball chain in mesh with the pockets of said sprocket, and a locking device selectively operable into position for locking said sprocket against rotation in at least one direction, said locking device having a dog selectively engageable with said sprocket for blocking rotation cf the sprocket and said locking device having an activating portion operable selectively by said ball chain into and out of position for causing the dog to engage with said sprocket.

2. A ball-chain drive as in claim 1 wherein said dog has a formation that cooperates with a pocket of the sprocket when the locking device locks the sprocket.

3. A ball-chain drive as in claim 1, wherein said ball chain when in cooperation with the activating portion of the locking device is arranged to shift said dog into cooperation with said sprocket when the sprocket draws the ball chain in said one direction.

4. A ball-chain drive as in claim 1, wherein said activating portion of the locking device includes at least one ball-receiving cavity and in which the dog has a formation receivable in a pocket of the sprocket, said formation being so spaced from said ball-receiving cavity of said activating portion that said formation tends to enter a ball-receiving cavity of said sprocket when the ball chain is meshed with the sprocket and a ball of the ball chain is received in said cavity.

5. A ball-chain drive as in claim 1, wherein said drive has obstructing means engageable by said locking device and wherein the locking device and the sprocket are so related that, after initial cooperation of the dog with the sprocket has been established by said activating portion, the sprocket in ensuing rotation carries the locking device against said obstructing means and thereby arrests the locking device which, in turn, arrests the sprocket against further rotation.

6. A ball-chain drive as in claim 1, wherein said locking device is a unitary part having an activating portion formed with at least one cavity for receiving a ball of the ball chain, a stop for arresting the locking device when the chain is pressed against said activating portion, said dog having a knob cooperable with a pocket of the sprocket, said knob being so spaced from said cavity in said activating portion that, when the ball chain is meshed with pockets of the sprocket and a ball of the ball chain is received in said cavity, rotation of the sprocket in said one direction causes the locking device to tilt about said stop and causes the knob to enter a pocket in the sprocket.

7. A ball-chain drive as in claim 6, wherein, when said knob is received in a said pocket, further rotation of the sprocket is effective to transport said locking device away from said stop, said ball-chain drive having means for blocking the transport of said locking device, thereby blocking the sprocket.

8. A ball-chain drive as in claim 1 for a wind-up blind that is weighted so that it tends to unwind, wherein said locking device has a second activating portion and a second dog cooperable with said sprocket, being mirror-images of the first-mentioned activating portion and the first-mentioned dog for adapting the ball-chain drive for use at either end of the wind-up blind.

9. A ball-chain drive as in claim 8, wherein each of said dogs is cooperable with a pocket of said sprocket.

10. A ball-chain drive as in claim 8, wherein said first-mentioned activating portion and said second activating portion and said first-mentioned dog and said second dog are portions of a unitary member.

11. A ball-chain drive for a wind-up blind that is weighted so that it tends to unwind, said drive including a support member, a sprocket carried by said support member and having regularly spaced peripheral pockets, a ball chain in mesh with an arcuate range of the pockets of said sprocket, a free range of the pockets remaining unoccupied by the ball chain, and a locking device selectively operable into position for locking said sprocket against rotation in at least one direction, said locking device having a dog cooperable with pockets of said sprocket in said free range and said locking device having an idle position in which the dog is disengaged from the sprocket, said locking device having an activating portion operable selectively by said ball chain for causing a portion of the dog to shift into a pocket of said sprocket.

12. A ball-chain drive as in claim 11 wherein incremental rotation of the sprocket displaces the dog while the dog remains in a pocket of the sprocket, and wherein the drive includes means for blocking the dog and thereby the sprocket against further rotation.

13. A ball-chain drive as in claim 11 wherein the chain is engageable with either of two opposite-end activating portions of the locking device and wherein the support member and the locking device have first cooperating portions that constrain the locking device to shift from its isle position into cooperation with the sprocket, the drive having means for maintaining that cooperation of the dog with the sprocket during an increment of rotation of the sprocket, and the drive having means for arresting the dog, thereby blocking further rotation of the sprocket.

14. A ball-chain drive for a wind-up blind, said drive including a support member, a rotary member carried by said support member and having regularly spaced peripheral pockets, a ball-chain in mesh with said pockets, and a locking device having a dog and said locking device being operable selectively by said ball chain for shifting the dog into interlocking engagement with the rotary member, and the drive having means for holding the dog of said locking device in interlocking engagement with the rotary member while the rotary member turns incrementally, the drive having means for arresting the locking device while the dog is held in interlocking engagement with the rotary member, the thus arrested locking device blocking the rotary member against further rotation.

15. A ball-chain drive as in claim 14, wherein said means for holding the dog in interlocked engagement with the rotary member includes mutually cooperative elements comprising a pin and an arcuate guide that curves around the rotary member, one of said cooperative elements being part of said support member and the other of said cooperative elements being part of said locking device, said arcuate guide having a relief for allowing disengagement of the dog from the rotary member for adapting the ball chain drive to be operated free of the locking device.

16. A ball-chain drive as in claim 15 wherein said arcuate guide is divided by said relief into two segments and wherein said locking device is operable by the ball chain for causing selective cooperation of said pin and either of said segments.

17. A drive for a wind-up blind wound on a core, there being a means tending to rotate the core in one direction for changing the amount of the blind that is wound on the core, said drive including a rotor to be unified to the core for rotation with the core, and a strand extending to said rotor and coupled to the rotor for operating the rotor in the direction opposite to said first direction, and locking means for arresting said rotor at a desired wound-up adjustment of the blind, said locking means including an annular formation on the rotor comprising a series of indentations, and a locking member having a dog engageable with said annular formation in a non-slipping manner, said dog being disengaged from said annular formation while the rotor is being operated for adjusting the blind, said locking member being operable in an initial mode by said strand for engaging said dog with said annular formation and said locking member being operable in a further mode in which the dog remains in engagement with said annular formation while the rotor moves through an incremental rotation in said first direction, said locking means including means for arresting the locking member with the dog in non-slipping engagement with the annular formation and thereby terminating said incremental rotation.

18. A drive as in claim 17 wherein said strand is a ball chain and said indentations are pockets complementary to the ball chain for adapting the ball chain to drive said rotor.

* * * * *